US010299550B2

(12) United States Patent
Uhre

(10) Patent No.: US 10,299,550 B2
(45) Date of Patent: May 28, 2019

(54) ELASTICALLY MODIFIABLE WALLET

(71) Applicant: Nick Lee Uhre, Rapid City, SD (US)

(72) Inventor: Nick Lee Uhre, Rapid City, SD (US)

( * ) Notice: Subject to any disclaimer, the term of this patent is extended or adjusted under 35 U.S.C. 154(b) by 0 days.

(21) Appl. No.: 15/821,742

(22) Filed: Nov. 22, 2017

(65) Prior Publication Data

US 2018/0140062 A1 May 24, 2018

Related U.S. Application Data

(60) Provisional application No. 62/425,382, filed on Nov. 22, 2016.

(51) Int. Cl.
*A45C 1/06* (2006.01)
*A45C 1/08* (2006.01)

(52) U.S. Cl.
CPC ..... *A45C 1/06* (2013.01); *A45C 1/08* (2013.01); *A45C 2001/065* (2013.01); *A45C 2001/083* (2013.01)

(58) Field of Classification Search
CPC A45C 1/06; A45C 11/182; A45C 1/08; A45C 2001/065; A45C 2001/083
USPC ..... 150/131, 132, 137; 24/16 R, 300, 301, 24/302, 306, 265 R, 17 B, 482
See application file for complete search history.

(56) References Cited

U.S. PATENT DOCUMENTS

D690,781 S * 10/2013 Uchytil ..... D21/662
8,573,458 B1 * 11/2013 Hamilton ..... A45F 5/021 224/250
8,695,150 B1 * 4/2014 Cooper ..... A45C 13/00 15/209.1
D750,369 S * 3/2016 Hamilton ..... D3/218
9,392,863 B2 * 7/2016 Hamilton ..... A45F 5/021
2002/0194711 A1 * 12/2002 Stampler ..... A45C 11/18 24/300
2009/0094795 A1 * 4/2009 Lazarus ..... A45C 1/02 24/3.12
2010/0065171 A1 * 3/2010 Uzelac ..... A45C 11/182 150/149
2010/0139049 A1 * 6/2010 Glickfield ..... A44C 5/003 24/3.7
2010/0205783 A1 * 8/2010 Bridgefarmer ..... A45C 11/182 24/21
2017/0086547 A1 * 3/2017 Richards ..... A45C 1/06
2018/0116352 A1 * 5/2018 Despain ..... A45C 1/06
2018/0250578 A1 * 9/2018 Sims ..... A63B 71/14

* cited by examiner

*Primary Examiner* — Fenn C Mathew
*Assistant Examiner* — Cynthia F Collado

(57) ABSTRACT

An elastically modifiable wallet is an apparatus that is able to hold and organize a user's financial or personal items in accordance to how frequently the user accesses each financial or personal item. The apparatus includes a tubular band, a tubular strap, a tubular strip, a finger loop, a first stitch, and a second stitch. The tubular band, the tubular strap, the tubular strip, and the finger loop are each made of elastic fabric. The tubular band is used to hold weekly/occasionally used items, such as business cards. The tubular strap is used to hold daily used items, such as a regular credit card. The tubular strip is used to hold frequently used items, such as loose cash. The finger loop allows a user to easily grasp and disengage the tubular strip. The first stitch and the second stitch are used to hold these pieces of elastic fabric together.

20 Claims, 4 Drawing Sheets

ELASTICALLY MODIFIABLE WALLET

The current application claims a priority to the U.S. Provisional Patent application Ser. No. 62/425,382 filed on Nov. 22, 2016.

FIELD OF THE INVENTION

The present invention generally relates to personal belongings and money holding device. More specifically, the present invention is a wallet that holds personal documents, personal cards, credit cards, and licenses, business cards, along with money, currency, or notes among others.

BACKGROUND OF THE INVENTION

Wallets are an item that are utilized by a majority of individuals every day, and help the user hold and organize their forms of payment along with other belongings like identification cards among others. Wallets are generally pocket-sized and are meant to be easily transported and accessed. As technology and methods of payments have shifted to forms other than cash, like credit or debit cards, gift cards, etc., wallet designs have tried to accommodate the changing culture by providing extra compartments and features to hold more than just cash.

The present invention is a wallet that holds personal documents, personal cards, credit cards, and licenses, business cards, along with money, currency, or notes among others. The wallet is made from an elastic component and is meant to cater to the user's financial habits. In its preferred embodiment, the present invention consists of a money clip component, a daily card use component, and an occasional/weekly card use component.

DETAILED DESCRIPTION OF THE INVENTION

All illustrations of the drawings are for the purpose of describing selected versions of the present invention and are not intended to limit the scope of the present invention.

Figure 1:
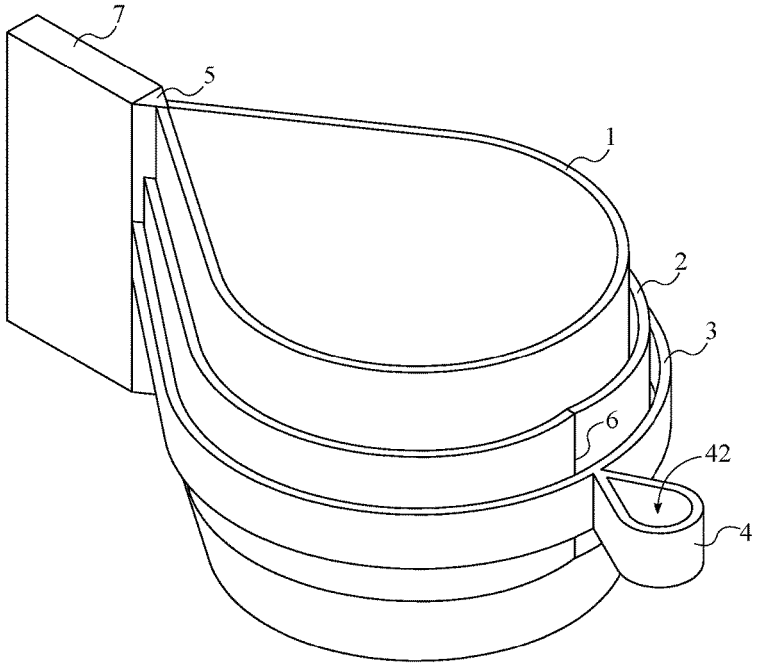
FIG. 1 is a front top perspective view of the present invention.
Figure 2:
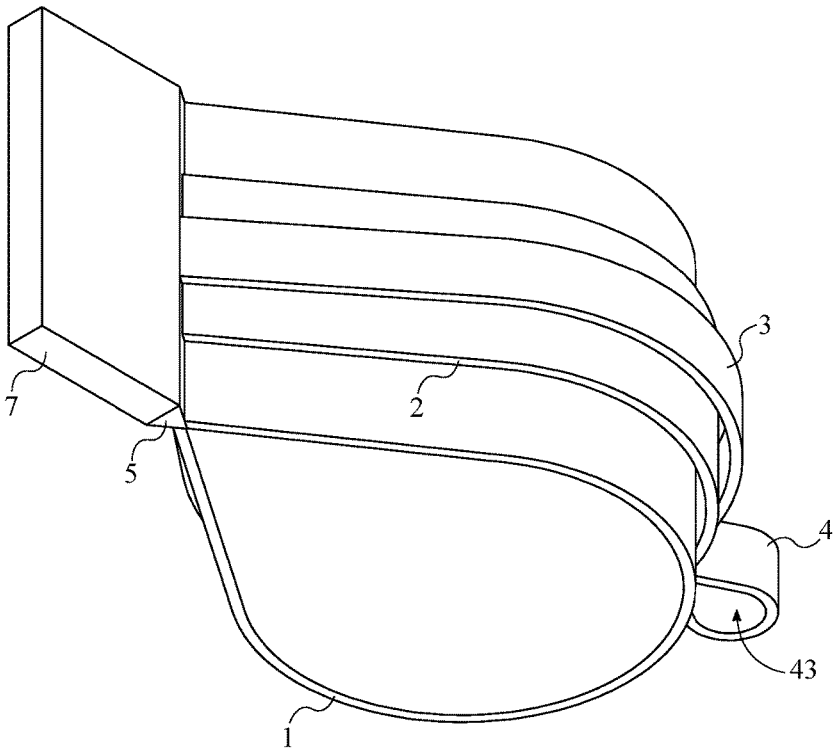
FIG. 2 is a rear bottom perspective view of the present invention.

The present invention is an elastically modifiable wallet that can be used to hold personal documents, personal cards, credit cards, licenses, business cards, cash/money, currency, notes, or any combination thereof. The present invention is compartmentalized so that a user can organize their readily accessed items, their daily accessed items, and their weekly/occasionally accessed items into the present invention. As can be seen in FIGS. 1 and 2, the present invention comprises a tubular band 1, a tubular strap 2, a tubular strip 3, a finger loop 4, a first stitch 5, and a second stitch 6. The tubular band 1, the tubular strap 2, and tubular strip 3 are all different annular pieces of elastic material with different heights in order to accommodate different items for the user. The tubular strip 3 is used to hold the user's readily accessed items, such as loose cash. The tubular strap 2 is used to hold the user's daily accessed items, such as a credit card that is used daily. The tubular band 1 is used to hold the user's weekly/occasionally accessed items, such as a driver's license that does not need to be used daily. The finger loop 4 is used to disengage the tubular strip 3 from the item being retained by the tubular strip 3. The first stitch 5 and the second stitch 6 are specific connection points on the tubular band 1, the tubular strap 2, and the tubular strip 3 that hold the present invention together without interfering with the functionality of the present invention. The first stitch 5 and the second stitch 6 can be, but are not limited to, some kind of thermal bonding glue or sewing thread. In addition, the tubular band 1, the tubular strap 2, the tubular strip 3, and the finger loop 4 are each made of an elastic fabric so that the circumference for each of these components is able to expand or retract at the user's discretion.

Figure 4:
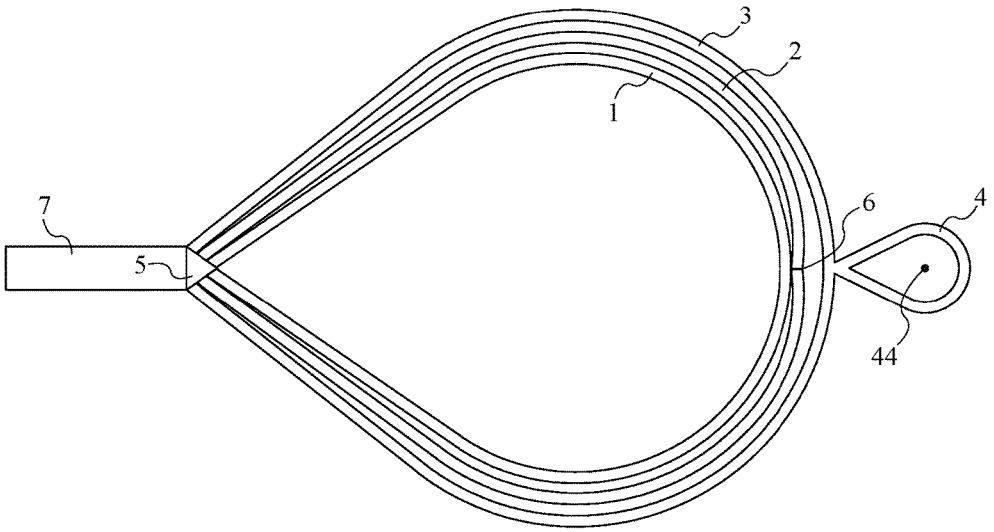
FIG. 4 is a top view of the present invention.

The general configuration of the aforementioned components allows the present invention to effectively and efficiently hold and organize a variety of financial items for the user. As can be seen in FIG. 4, the tubular band 1 is encircled by the tubular strap 2, and the tubular strap 2 is encircled by the tubular strip 3, which positions more-frequently accessed items on the outer portions of the present invention and positions less-frequently accessed items on the inner portions of the present invention. Moreover, the tubular band 1, the tubular strap 2, and the tubular strip 3 are tangentially connected along the first stitch 5, while only the tubular band 1 and the tubular strap 2 are tangentially connected along the second stitch 6. Consequently, the first stitch 5 and the second stitch 6 are able to properly secure the tubular band 1, the tubular strap 2, and tubular strip 3 in place on the present invention, while allowing the entire circumference of either the tubular band 1, the tubular strap 2, or tubular strip 3 to be available for retaining any of the user's financial items. In addition, the first stitch 5 and the second stitch 6 are diametrically opposed to each other about the tubular band 1 and are positioned parallel to each other so that the area enclosed between the tubular band 1 and the tubular strap 2 is divided into two separate slots that can be used to retain the user's financial items. Furthermore, the finger loop 4 is connected adjacent to the tubular strip 3 so that the user is able to easily identify and grasp the finger loop 4. The finger loop 4 is also positioned adjacent to the second stitch 6, which optimally offsets the finger loop 4 from the connection point between the first stitch 5 and the tubular strip 3 and allows the user to more easily expand or retract the tubular strip 3.

Figure 3:
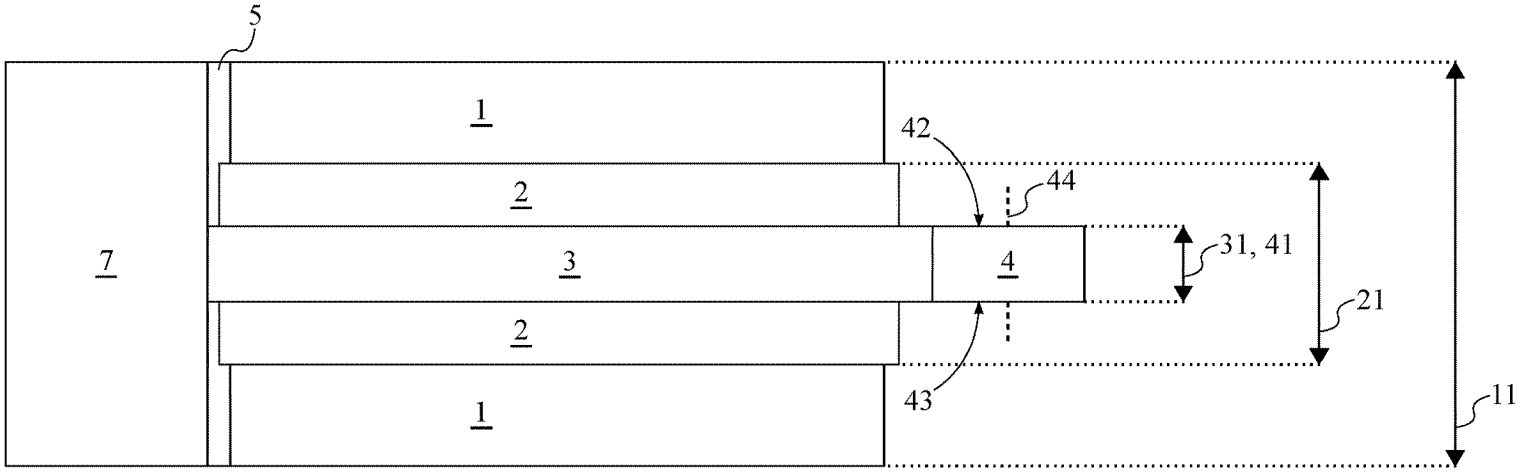
FIG. 3 is a side view of the present invention.

In the preferred embodiment of the present invention, the heights of the tubular band 1, the tubular strap 2, and the tubular strip 3 are sized so that the user can easily differentiate and separately grasp the tubular band 1, the tubular strap 2, or the tubular strip 3. As can be seen in FIG. 3, the height 11 of the tubular band 1 and the height 21 of the tubular strap 2 is preferably at a ratio of 2:1, while the height 21 of the tubular strap 2 and the height 31 of the tubular strip 3 is at a ratio of 8:3. Moreover, the height 31 of the tubular strip 3 is equal to the height 41 of the finger loop 4. In an exemplary embodiment of the present invention, the height 11 of the tubular band 1 is 2 inches, the height 21 of the tubular strap 2 is 1 inch, and the heights 31, 41 of the tubular strip 3 and the finger loop 4 are 0.375 inches. Also in the preferred embodiment of the present invention, the tubular strap 2 is centrally positioned along the height 11 of the tubular band 1, and the tubular strip 3 and the finger loop 4 are centrally positioned along the height 21 of the tubular strap 2, which further assists the user to differentiate and to separately grasp the tubular band 1, the tubular strap 2, or the tubular strip 3.

As can be seen in FIG. 1 through 4, the orientation of the finger loop 4 also allows the user to easily grasp the finger loop 4 and to pull on the tubular strip 3. The finger loop 4 comprises a first opening 42, a second opening 43, and a central axis 44. The first opening 42 and the second opening 43 allows a user's finger to enter and exit the finger loop 4 and, thus, are positioned opposite to each other along the finger loop 4. The central axis 44 is used to delineate the lumen of the finger loop 4 and, thus, traverses normal through the first opening 42 and the second opening 43. The central axis 44 is also positioned parallel to the first stitch 5 and the second stitch 6 so that the user is able to ergonomically grip the finger loop 4 and pull the tubular strip 3 off of the tubular strap 2. In addition, the present invention may further comprise a grasping tab 7 in order to grasp the present invention without agitating the financial items that are retained within the tubular band 1, the tubular strap 2, or the tubular strip 3. The grasping tab 7 is connected along the first stitch 5 in order to avoid the movement area of the tubular band 1, the tubular strap 2, and the tubular strip 3.

The present invention is compositionally manufactured for longevity and optimal functionality as the tubular band 1, the tubular strap 2, the tubular strip 3, and the finger loop 4 are continuously stretched and retracted through continuous daily use of the present invention. The elastic fabric of the tubular band 1 is preferably configured with a composition of 67% polyester and 33% rubber, which is moderately elastic in comparison to the tubular strap 2, the tubular strip 3, and the finger loop 4. The elastic fabric of the tubular strap 2 is preferably configured with a composition of 78% polyester and 22% rubber, which is the least elastic in comparison to the tubular band 1, the tubular strip 3, and the finger loop 4. The elastic fabric of the tubular strip 3 and the elastic fabric of the finger loop 4 are preferably configured with a composition of 55% polyester and 45% rubber, which is the most elastic in comparison to the tubular band 1 and the tubular strap 2. The variation in elasticity for the tubular band 1, the tubular strap 2, and the tubular strip 3 is used to accommodate the different frequencies of use for the financial items that are held by the present invention.

The present invention may also include some miscellaneous features in order to improve its functionality. One such miscellaneous feature is to have stitching on the perimeter of the tubular band 1, the tubular strap 2, the tubular strip 3, or a combination thereof in order to increase the structural integrity of the present invention.

Although the invention has been explained in relation to its preferred embodiment, it is to be understood that many other possible modifications and variations can be made without departing from the spirit and scope of the invention as hereinafter claimed.

What is claimed is:

1. An elastically modifiable wallet comprises:
- a tubular band;
- a tubular strap;
- a tubular strip;
- a finger loop;
- a first stitch;
- a second stitch;
- the tubular band, the tubular strap, the tubular strip, and the finger loop each being made of an elastic fabric;
- the tubular band being encircled by the tubular strap;
- the tubular strap being encircled by the tubular strip;
- the tubular band, the tubular strap, and the tubular strip being tangentially connected along the first stitch;
- the tubular band and the tubular strap being tangentially connected along the second stitch;
- the first stitch and the second stitch being diametrically opposed to each other about the tubular band;
- the first stitch and the second stitch being positioned parallel to each other;
- the finger loop being positioned adjacent to second stitch; and
- the finger loop being connected adjacent to the tubular strip.

2. The elastically modifiable wallet as claimed in claim 1 comprises:
- the tubular strap being centrally positioned along a height of the tubular band; and
- the tubular strip and the finger loop being centrally positioned along a height of the tubular strap.

3. The elastically modifiable wallet as claimed in claim 1 comprises:
- a height of the tubular band and a height of the tubular strap being at a ratio of 2:1;
- the height of the tubular strap and a height of the tubular strip being at a ratio of 8:3; and
- the height of the tubular strip being equal to a height of the finger loop.

4. The elastically modifiable wallet as claimed in claim 3 comprises:
- the height of the tubular band being 2 inches;
- the height of the tubular strap being 1 inch;
- the height of the tubular strip being 0.375 inches; and
- the height of the finger loop being 0.375 inches.

5. The elastically modifiable wallet as claimed in claim 1 comprises:
- the finger loop comprises a first opening, a second opening, and a central axis;
- the first opening and the second opening being positioned opposite to each other along the finger loop;
- the central axis traversing normal through the first opening and the second opening; and
- the central axis being positioned parallel to the first stitch and the second stitch.

6. The elastically modifiable wallet as claimed in claim 1 comprises:
- a grasping tab; and
- the grasping tab being connected along the first stitch.

7. The elastically modifiable wallet as claimed in claim 1, wherein the elastic fabric of the tubular band is configured with a composition of 67% polyester and 33% rubber.

8. The elastically modifiable wallet as claimed in claim 1, wherein the elastic fabric of the tubular strap is configured with a composition of 78% polyester and 22% rubber.

9. The elastically modifiable wallet as claimed in claim 1, wherein the elastic fabric of the tubular strip is configured with a composition of 55% polyester and 45% rubber.

10. The elastically modifiable wallet as claimed in claim 1, wherein the elastic fabric of the finger loop is configured with a composition of 55% polyester and 45% rubber.

11. An elastically modifiable wallet comprises:
- a tubular band;
- a tubular strap;
- a tubular strip;
- a finger loop;
- a first stitch;
- a second stitch;
- the finger loop comprises a first opening, a second opening, and a central axis;
- the tubular band, the tubular strap, the tubular strip, and the finger loop each being made of an elastic fabric;
- the tubular band being encircled by the tubular strap;
- the tubular strap being encircled by the tubular strip;

the tubular band, the tubular strap, and the tubular strip being tangentially connected along the first stitch;

the tubular band and the tubular strap being tangentially connected along the second stitch;

the first stitch and the second stitch being diametrically opposed to each other about the tubular band;

the first stitch and the second stitch being positioned parallel to each other;

the finger loop being positioned adjacent to second stitch;

the finger loop being connected adjacent to the tubular strip;

the tubular strap being centrally positioned along a height of the tubular band;

the tubular strip and the finger loop being centrally positioned along a height of the tubular strap;

the first opening and the second opening being positioned opposite to each other along the finger loop;

the central axis traversing normal through the first opening and the second opening; and the central axis being positioned parallel to the first stitch and the second stitch.

12. The elastically modifiable wallet as claimed in claim 11 comprises:

a height of the tubular band and a height of the tubular strap being at a ratio of 2:1;

the height of the tubular strap and a height of the tubular strip being at a ratio of 8:3; and the height of the tubular strip being equal to a height of the finger loop.

13. The elastically modifiable wallet as claimed in claim 12 comprises:

the height of the tubular band being 2 inches;

the height of the tubular strap being 1 inch;

the height of the tubular strip being 0.375 inches; and the height of the finger loop being 0.375 inches.

14. The elastically modifiable wallet as claimed in claim 11 comprises:

a grasping tab; and the grasping tab being connected along the first stitch.

15. The elastically modifiable wallet as claimed in claim 11 comprises:

the elastic fabric of the tubular band being configured with a composition of 67% polyester and 33% rubber;

the elastic fabric of the tubular strap being configured with a composition of 78% polyester and 22% rubber;

the elastic fabric of the tubular strip being configured with a composition of 55% polyester and 45% rubber; and the elastic fabric of the finger loop is configured with a composition of 55% polyester and 45% rubber.

16. An elastically modifiable wallet comprises:

a tubular band;

a tubular strap;

a tubular strip;

a finger loop;

a first stitch;

a second stitch;

the tubular band, the tubular strap, the tubular strip, and the finger loop each being made of an elastic fabric;

the tubular band being encircled by the tubular strap;

the tubular strap being encircled by the tubular strip;

the tubular band, the tubular strap, and the tubular strip being tangentially connected along the first stitch;

the tubular band and the tubular strap being tangentially connected along the second stitch;

the first stitch and the second stitch being diametrically opposed to each other about the tubular band;

the first stitch and the second stitch being positioned parallel to each other;

the finger loop being positioned adjacent to second stitch;

the finger loop being connected adjacent to the tubular strip;

the tubular strap being centrally positioned along a height of the tubular band;

the tubular strip and the finger loop being centrally positioned along a height of the tubular strap;

the elastic fabric of the tubular band being configured with a composition of 67% polyester and 33% rubber;

the elastic fabric of the tubular strap being configured with a composition of 78% polyester and 22% rubber;

the elastic fabric of the tubular strip being configured with a composition of 55% polyester and 45% rubber; and the elastic fabric of the finger loop is configured with a composition of 55% polyester and 45% rubber.

17. The elastically modifiable wallet as claimed in claim 16 comprises:

a height of the tubular band and a height of the tubular strap being at a ratio of 2:1;

the height of the tubular strap and a height of the tubular strip being at a ratio of 8:3; and the height of the tubular strip being equal to a height of the finger loop.

18. The elastically modifiable wallet as claimed in claim 17 comprises:

the height of the tubular band being 2 inches;

the height of the tubular strap being 1 inch;

the height of the tubular strip being 0.375 inches; and the height of the finger loop being 0.375 inches.

19. The elastically modifiable wallet as claimed in claim 16 comprises:

the finger loop comprises a first opening, a second opening, and a central axis;

the first opening and the second opening being positioned opposite to each other along the finger loop;

the central axis traversing normal through the first opening and the second opening; and the central axis being positioned parallel to the first stitch and the second stitch.

20. The elastically modifiable wallet as claimed in claim 16 comprises:

a grasping tab; and the grasping tab being connected along the first stitch.

* * * * *